US006324959B1

(12) United States Patent
Akasaka et al.

(10) Patent No.: US 6,324,959 B1
(45) Date of Patent: Dec. 4, 2001

(54) PISTON PUMP MOTOR

(75) Inventors: Toshiyuki Akasaka; Sadao Nunotani; Koichi Morita, all of Oyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/355,862

(22) PCT Filed: Feb. 3, 1998

(86) PCT No.: PCT/JP98/00437

§ 371 Date: Sep. 20, 1999

§ 102(e) Date: Sep. 20, 1999

(87) PCT Pub. No.: WO98/34027

PCT Pub. Date: Aug. 6, 1998

(30) Foreign Application Priority Data

Feb. 4, 1997 (JP) ..... 9-034276

(51) Int. Cl.[7] ..... F01B 13/04; F01B 31/10
(52) U.S. Cl. ..... 92/57; 92/158
(58) Field of Search ..... 92/57, 158, 159

(56) References Cited

U.S. PATENT DOCUMENTS 3,153,987 * 10/1964 Thoma ..... 92/158

FOREIGN PATENT DOCUMENTS 60-19776 2/1985 (JP) .
6-26447 2/1994 (JP) .
7-189889 7/1995 (JP) .

* cited by examiner

*Primary Examiner*—Edward K. Look
*Assistant Examiner*—Michael Leslie
(74) *Attorney, Agent, or Firm*—Sidley Austin Brown & Wood

(57) ABSTRACT

The invention can prevent a heat generation and a seizure due to a sliding friction between a piston and a cylinder in inclined shaft type and swash plate type hydraulic pumps even when they are made high speed. In order to achieve this, a piston pump motor comprises a cylinder block (20) rotatably supported within a case (32), having suction and discharge ports (21) in a side of one cylindrical end surface, being provided with a plurality of cylinder holes (22) connected to the suction and discharge ports and arranged on an inside circumference at a uniform interval, and a piston (11) rotated by a drive shaft (31), sliding within the cylinder hole in a sealing manner and having a part moving forward and backward from a side of the other end surface of the cylinder block, wherein an oil introduction groove (13) communicating with an inner portion of the case is provided in any one of a portion disposed on an outer periphery of the piston and moving forward and backward from the side of the other end surface of the cylinder block, and a portion disposed on an inner periphery of the cylinder hole and at which a part of the piston moves forward and backward from the side of the other end surface.

6 Claims, 7 Drawing Sheets

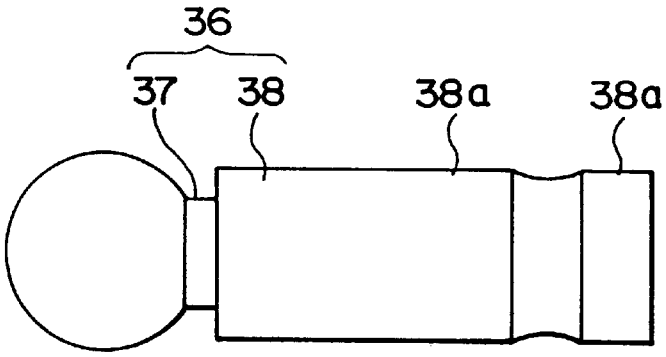
FIG. 7A
PRIOR ART
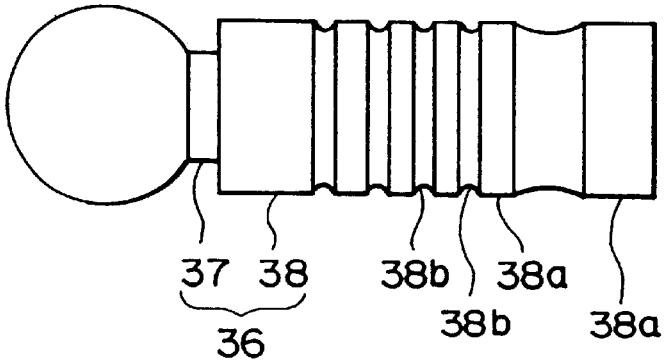
FIG. 7B
PRIOR ART
FIG. 8 PRIOR ART
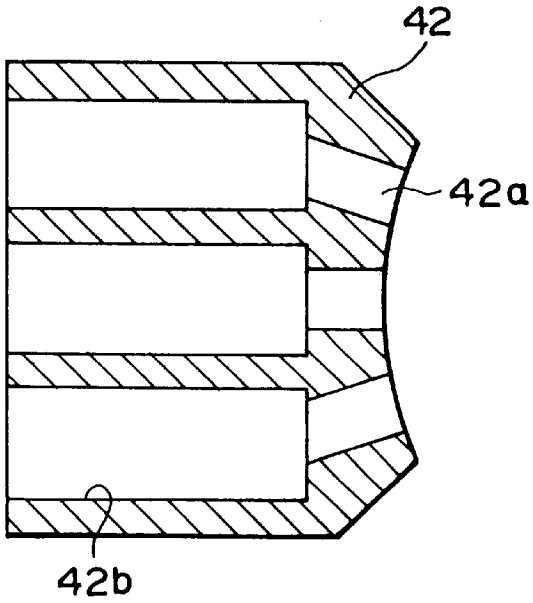

PISTON PUMP MOTOR

FIELD OF THE INVENTION

The present invention relates to a piston pump motor, and more particularly to a shape of a piston and a cylinder block in inclined shaft type and swash plate type hydraulic pumps which can be applied to a high rotational speed.

BACKGROUND OF THE INVENTION

Conventionally, there has been known a piston pump which rotates a cylinder block apparatus via a drive shaft by a power of a drive source and oscillates a piston within a cylinder block, thereby sucking an oil from a tank and discharging a high pressurized oil so as to convert a mechanical energy to a fluid energy. Further, there has been known a piston motor which introduces a high pressurized oil within a cylinder block from a pump and oscillates a piston, thereby rotating a cylinder block apparatus and a drive shaft so as to convert a fluid energy to a mechanical energy. In this case, a basic structure of the cylinder block apparatus is common in both of the piston pump and the piston motor.

An embodiment of an inclined shaft type piston motor having a cylinder block apparatus 30 will be shown in FIG. 6. A drive shaft 31 is supported by bearings 33 and 34 received in a case 32 so as to be rotated. A flange portion 31*a* is integrally formed in an end side of the drive shaft 31. A ball 35*a* integrally formed with a center shaft 35 is assembled on a rotary shaft core X of the drive shaft 31 in the flange portion 31*a,* and the center shaft 35 is oscillated in a vertical direction at a predetermined inclination angle with respect to the rotary shaft core X of the drive shaft 31 an inclination angle control apparatus 60.

A plurality of piston assemblies 36 are arranged in the flange portion 31*a* from the rotary shaft core X of the drive shaft 31 in such a manner as to be on the same circumference. The piston assemblies 36 are constituted by piston rods 37 and pistons 38 and slidably connected. The piston rod 37 has spherical portions 37*a* and 37*b* at both ends and both portions are connected by a rod 37*c*.

The piston 38 is constituted by a circular column having a circular hole pierced in an axial direction from a side of an end surface, and a bottom of the hole is formed in a semispherical shape. The spherical portion 37*a* at one end portion of the piston rod 37 is inserted to the semispherical portion in the bottom of the hole of the piston 38, and both elements are connected by deforming an outer diameter of the piston 38. The piston 38 can be oscillated in a range at which the piston rod 37 is brought into contact with the hole. Further, the spherical portion 37*b* in the other end portion of the piston rod 37 is mounted to the flange portion 31*a* of the drive shaft 31 in such a manner as to freely oscillate. Accordingly, the piston 38 is mounted to each of the drive shaft 31 and the piston rod 37 in such a manner as to freely oscillate. An outer diameter in a side of the other end surface of the piston 38 is inserted to a cylinder block 42 mentioned below in a sealed manner, thereby sealing a high pressurized oil acting on the side of the other end surface of the piston 38 by an outer circumference portion 38*a* (shown in FIGS. 7A and 7B) of the piston 38.

A shape of the outer circumference portion 38*a* of the piston 38 includes a straight shape without a groove (FIG. 7A) and a shape in which a plurality of labyrinth grooves 38*b* not communicating with each other in a longitudinal direction are cut (FIG. 7B).

A case drain 39 shown in FIG. 6 is formed in an inner portion of the case 32, and an oil leaking from a gap between the piston assembly 36 and the cylinder block 42 is discharged from a drain port 41 to a tank (not shown) via a case drain 39. Since a pressure is uniformly distributed all around the periphery due to a function of the labyrinth groove 38*b,* the piston 38 is held near a center of the hole 42*b* of the cylinder block 42. As a result, the piston 38 is not directly brought into contact with the hole 42*b* even when the piston 38 oscillates within the hole 42*b,* so that a heat generation due to a sliding friction can be restricted to a low level. Further, since the labyrinth groove 38*b* projects to a side of the case drain 39 having a low temperature from the cylinder block 42 due to an oscillation of the piston 38, the high temperature oil in the labyrinth groove 38*b* can be discharged or cooled.

The cylindrical cylinder block 42 shown in FIG. 8 oscillates in a vertical direction with respect to the rotary shaft core X of the drive shaft 31 in accordance with an oscillation in a vertical direction of a center shaft 35 by the inclination angle control apparatus 60 mentioned above. Accordingly, the cylinder block 42 rotates around a rotary shaft core Y of the center shaft 35.

The side of one end surface of the cylinder block 42 is formed in a concave spherical surface shape, and the spherical surface has a plurality of suction and discharge ports 42*a* and is slidably brought into contact with a convex spherical surface of the valve plate 43. A plurality of cylinder block holes 42*b* (hereinafter, refer to as cylinder holes 42*b*) are pierced in the side of the other end surface of the cylinder block 42 at the same number as that of the piston assemblies 36 mounted to the flange portion 31*a* at an equal interval on a circumference inside the cylinder block 42. These cylinder holes 42*b* are connected to a plurality of suction and discharge ports 42*a,* and a plurality of piston assemblies 36 are inserted to each of the cylinder holes 42*b* at a sealing interval in such a manner as to freely oscillate. The high pressurized oil from each of the suction and discharge ports 42*a* acts on the end surface of each of the piston assemblies 36.

The ball 35*a* in the side of one end of the center shaft 35 is assembled in the flange portion 31*a,* however, the side of the other end is supported by the bearing 44 of the valve plate 43. The valve plate inclines on a sliding surface 45 having a concave spherical surface shape and formed in the inclination angle control apparatus 60 around a core Z of the ball 35*a* of the center shaft 35. In this case, the inclination angle corresponds to an inclination of the rotary core Y of the cylinder block 42 with respect to the rotary shaft core X of the drive shaft 31, and is adjusted by the inclination angle control apparatus 60.

In this case, when adjusting the inclination angle a little, the cylinder block 42 comes near to the rotary shaft core X of the drive shaft 31, so that the piston assembly 36 is further inserted within the cylinder block 42 and a stroke S (a difference of at amount between forward and backward positions of the piston) becomes small. As a result, since a space capacity between the cylinder block 42 and the piston assembly 36 is reduced, a number of oscillation per a unit time of the piston assembly 36 is increased in the case of the constant inlet amount, so that a number of rotation of the drive shaft 31 connected to the cylinder block 42 is increased. That is, when the inclination angle is reduced, it becomes a high speed rotation, and inversely when the inclination angle is increased, it becomes a low speed rotation. Further, when the inclination angle is 0, that is, the rotary shaft core X of the drive shaft 31 and the rotary shaft core Y of the cylinder block 42 are on the same axis, the stroke S becomes 0, the piston assembly 36 is not going to oscillate, and the drive shaft 31 is not going to rotate.

A sheet 46 and a spring 47 are arranged between the center shaft 35 and the cylinder block 42, thereby keeping a contact state in the spherical sliding surface formed by the cylinder block 42 and the valve plate 43 by a pressing force of the spring 47. The suction and discharge port 42*a* of the cylinder block 42 is connected to an inlet for a pressurized and a discharge oil outlet (not shown) of the valve plate 43.

In accordance with the structure mentioned above, since the cylinder block apparatus 30 cools and lubricates by the high pressurized oil leaked from the gap with respect to the cylinder block 42 or the oil stored in the labyrinth groove 38*b* on the outer periphery of the piston 38 even when the piston assembly 36 oscillates, it is possible to prevent a sliding friction heat and a seizure generated by an oscillation of the piston assembly 36 within the cylinder block 42.

However, a market of the piston pump and motor tends to a high speed (a high rotational speed) in view of an embodiment of a high speed travel of the hydraulic excavator. When the rotation is performed at a high speed, the upper piston assembly 36 in FIG. 6 is further inserted within the cylinder block 42, an insertion depth of the lower piston assembly 36 becomes small, and the stroke S becomes small. Since the number of oscillation per a unit time becomes more in accordance with this, the opposing circumferential surfaces of the piston assembly 36 and the cylinder block 42 are locally heated to be a high temperature. Further, when the piston assembly 36 is inserted within the cylinder block 42 and the stroke S becomes small, the labyrinth groove 38*b* hardly protrudes to the side of the low temperature case drain 38 from the cylinder block 42, so that the high temperature oil stored in the labyrinth groove 38*b* is not discharged, and a cooling effect is reduced.

Further, when the cylinder block apparatus 30 rotates at a high speed around the rotary shaft core Y of the cylinder block 42, the piston assembly 36 is shifted to the side of the outer periphery of the cylinder hole 42*b* in the cylinder block 42 due to a centrifugal force. As a result, as shown in FIG. 5, since the piston assembly 36 is exposed to overlapped bad conditions that an oscillating motion at a high cycle is performed under a state of being strongly pressed to the outer peripheral surface of the hole 42*b*, a heat generation due to the sliding friction and the seizure are locally generated. This phenomenon becomes significant as the piston pump and motor are made high speed (high rotational speed).

Further, there is a method of increasing a gap between the cylinder block 42 and the piston 38 in order to prevent the heat generation due to the sliding friction mentioned above and increasing an amount of the oil leaking to the case drain 39 so as to cool. However, a capacity efficiency (a ratio between an actual discharge amount and a theoretical discharge amount including a leakage and the like in the case of the pump, and a ratio between a theoretical inlet amount and an actual inlet amount in the case of the motor) corresponding to a basic performance of the piston pump and motor is reduced. In particular, in an area of the number of rotational of about 500 rpm at the low speed, it is significantly reduced.

FIG. 9 is a graph obtained by actually measuring a relation of a gap of a diameter (μm), a leaking amount (l/min) and a capacity efficiency (%) between each of the piston and the cylinder hole 42*b* of the piston and the cylinder block 42 with respect to the piston motor having a rated capacity (160 cc/rev) with changing a pressure. That is, the leaking amount and the capacity efficiency at symbols B and C are shown in Table 1 with setting the gap of the diameter of a symbol A to a reference. A piston in which a plurality of labyrinth grooves 38*b* shown in FIG. 7B are cut is employed as the piston 38.

TABLE 1

EXPERIMENTAL VALUE OF GAP OF DIAMETER. LEAKING AMOUNT AND CAPACITY EFFICIENCY

| SYMBOL | GAP OF DIAMETER (pm) | LEAKING AMOUNT (1/min) | CAPACITY EFFICIENCY (%) |
|---|---|---|---|
| A | REFERENCE | REFERENCE | REFERENCE |
| B | REFERENCE + 10 | REFERENCE + 3 | REFERENCE − 4 |
| C | REFERENCE + 20 | REFERENCE + 7 | REFERENCE − 9 |

SET GAP OF A DIAMETER TO REFERENCE
PRESSURE: 350 kg/cm$^2$
NUMBER OF ROTATION: 500 rpm In Table 1, in the case of the symbol B, when making the gap of the diameter between the piston 38 and the cylinder hole 42*b* of the cylinder block 412 10 μm greater than the reference gap of the diameter at the symbol A, the leaking amount is 3 l/min increased and the capacity efficiency is 4% reduced. In the case of the symbol C in which the gap of the diameter is made 20 μm greater, the leaking amount is 7 l/min increased and the capacity efficiency is 9% reduced. As mentioned above, since the capacity efficiency is reduced, thereby generating a heat when the gap of the diameter is made greater, a method of increasing the gap can not be employed.

SUMMARY OF THE INVENTION

The present invention is made by taking the conventional problems mentioned above into consideration, and an object of the present invention is to provide a cylinder block apparatus which can prevent a heat generation and a seizure due to a sliding friction between a piston and a cylinder in inclined shaft type and swash plate type hydraulic pumps in response to a high speed of a piston pump motor.

In accordance with a first aspect of the present invention, there is provided a piston pump motor comprising a cylinder block rotatably supported within a case, having suction and discharge ports in a side of one cylindrical end surface, being provided with a plurality of cylinder holes connected to the suction and discharge ports and arranged on an inside circumference at a uniform interval, and a piston rotated by a drive shaft, sliding within the cylinder hole in a sealing manner and having a part moving forward and backward from a side of the other end surface of the cylinder block, wherein an oil introduction groove communicating with an inner portion of the case is provided in any one of a portion disposed on an outer periphery of the piston and moving forward and backward from the side of the other end surface of the cylinder block and a portion disposed on an inner periphery of the cylinder hole and at which a part of the piston moves forward and backward from the side of the other end surface.

In accordance with the structure mentioned above, when the high pressurized oil flows within the cylinder hole of the cylinder block from the pump through the valve plate, the oil introduction groove positioned at the side of the case drain and communicating therewith is arranged on any one of the outer periphery of the piston and the inner periphery of the cylinder, the high pressurized oil leaked from the seal land flows through the oil introduction groove and lubricates and cools all the periphery of the piston, thereby preventing a heat generation and a seizure. Further, when the inclination angle of the cylinder block is small (the discharge capacity is small), that is, an oscillation is repeated at a high cycle when the stroke of the piston is small, conventionally, the labyrinth groove never moves to an outer portion of the cylinder block, the oil at the portion becomes a high temperature, however, in accordance with the present invention, since the oil introduction groove is communicated with the inner portion of the case, the oil is replaced and becomes never a high temperature. Accordingly, it is possible to prevent a heat generation and a seizure, and it is possible to rotate the piston pump and the motor at high speed.

In accordance with a second aspect of the present invention, there is provided a piston pump motor comprising a cylinder block rotatably supported within a case, having suction and discharge ports in a side of one cylindrical end surface of and provided with a plurality of cylinder holes connected to the suction and discharge ports and arranged on an inside circumference at a uniform interval, and a piston rotated by a drive shaft, sliding within the cylinder hole in a sealing manner and having a part moving forward and backward from a side of the other end surface of the cylinder block, wherein the piston pump motor is provided with at least one of the piston in which an outer periphery of a portion moving forward and backward form a side of the other end surface of the cylinder block has a diameter smaller than that of the outer periphery in the side of the suction and discharge port, and the cylinder hole in which an inner periphery of a portion moving forward and backward a part of the piston from the side of the other end surface of the cylinder block has a diameter larger than that of the inner periphery in the side of the suction and discharge port.

In accordance with the structure mentioned above, since the outer diameter of the piston in the side of the case drain is made smaller in comparison with the side of the suction and discharge port, or the inner diameter of the cylinder in the side of the case drain is made larger in comparison with the side of the suction and discharge port, the gap in the side of the case drain becomes larger in any cases, so that the high pressurized oil leaking from the seal land can lubricate and cool all the periphery of the piston through the gap larger than the seal land portion, thereby preventing a heat generation and a seizure. Further, the piston is never pressed to the cylinder in the side of the case drain. Still further, since the gap in the side of the suction and discharge port is not changed in comparison with the conventional structure, a leakage is not increased and a capacity efficiency is not reduced, so that the piston pump and motor can be rotated at a high speed.

In accordance with a third aspect as cited in the second aspect, there is provided a piston pump motor, wherein an oil introduction groove communicating with the inner portion of the case is provided in at least any one of the small diameter portion on the outer periphery of the piston and the large diameter portion on the inner periphery of the cylinder hole.

In addition to an operation and effect of the second aspect, it is possible to more efficiently lubricate and cool all the periphery of the piston since the oil introduction groove communicating with the inner portion of the case is provided, so that a heat generation and a seizure can be prevented.

In accordance with a fourth aspect as cited in the first, second or third aspect, there is provided a piston pump motor, wherein the outer periphery of the piston is provided with a high pressurized oil seal land for sealing a high pressurized oil in a side of the suction and discharge port and with an outer peripheral groove having a predetermined width, being disposed adjacent to the seal land and connected to any one of the oil introduction groove communicating with the inner portion of the case and the small diameter portion on the outer periphery of the piston.

Since between the oil introduction groove and the seal land or between the small diameter portion on the outer periphery of the piston and the seal land, the outer peripheral groove communicating with them is provided so that the oil is reserved, the cylinder hole communicating with the valve plate becomes a low pressure from a high pressure, and a portion between the piston and the cylinder hole can be lubricated by the oil reserved in the outer peripheral groove without the oil leakage from the seal land.

In accordance with a fifth invention as cited in the first or third aspect, there is provided a piston pump motor, wherein the oil introduction groove has a shape inclined with respect to an oscillating direction of the piston.

Accordingly, the high pressurized oil leaking from the seal land to the oil introduction groove is supplied to the outer periphery of the piston along the inclined oil introduction groove, so that a uniform cooling effect can be obtained all around the periphery.

In this case, since the present invention is only structured such that the oil groove and the like are provided in the conventional piston or cylinder hole, there is an advantage that the structure is simple and a structure as the cylinder block apparatus is the same.

BRIEF DESCRIPTION OF THE DRAWINGS

FIGS. 3A to 2B are views which show sixth to seventh embodiments of a cylinder block in accordance with a cylinder block apparatus shown in FIG. 1;

FIGS. 7A to 7B are views which show a piston assembly in accordance with a conventional cylinder block apparatus;

FIG. 8 is a view which shows a cylinder block in accordance with the conventional cylinder block apparatus.

BEST MODE FOR CARRYING OUT THE INVENTION

Figure 1:
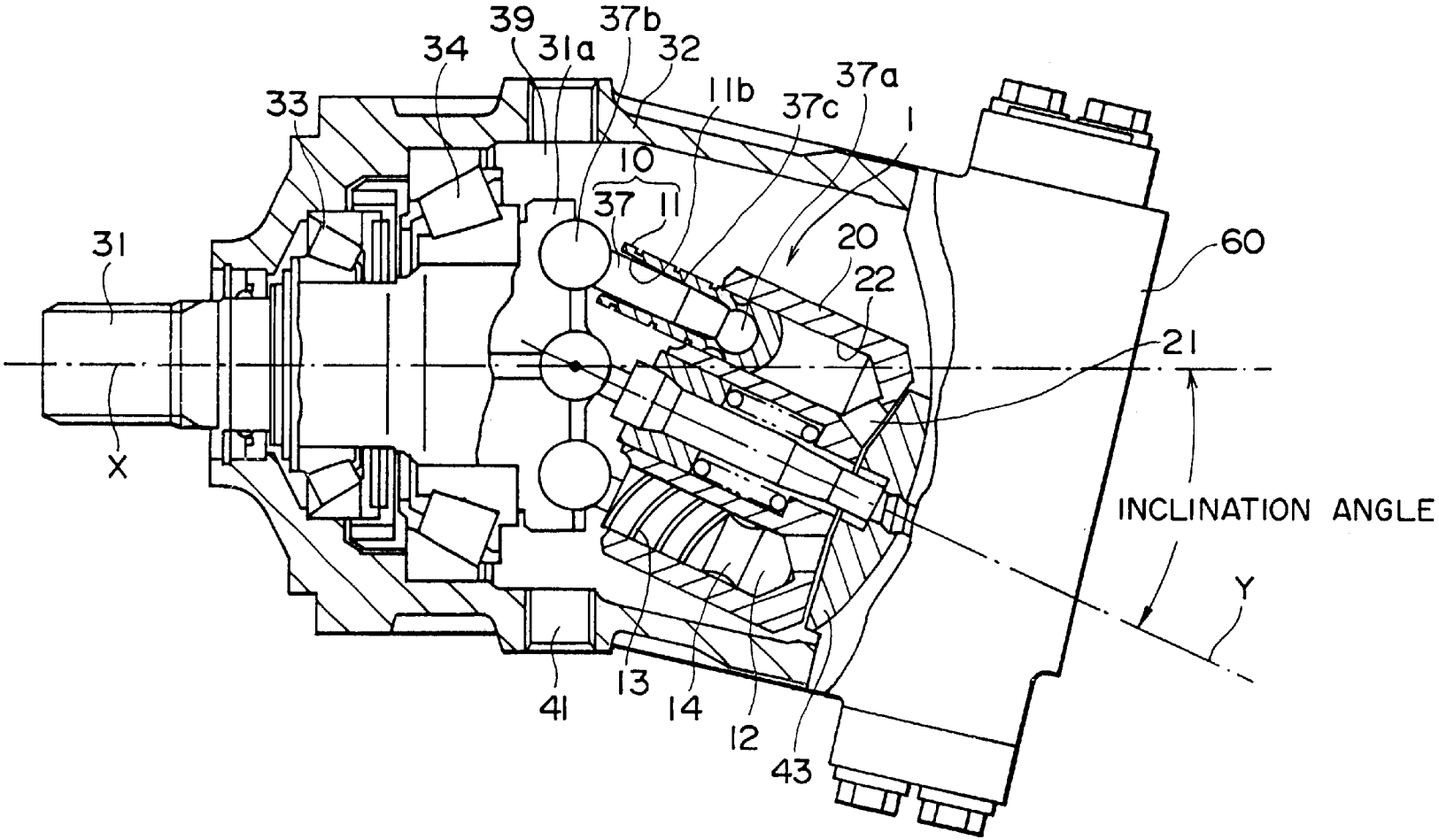
FIG. 1 is a cross sectional view of a piston motor in accordance with the present invention.

An embodiment of a piston pump and motor in accordance with the present invention will be in detail described below with reference to FIGS. 1 to 4. In this case, since elements except a cylinder block apparatus 1 in accordance with the present invention are the same as those of the conventional art, the same reference numerals will be attached to the same elements and a description thereof will be omitted.

In FIG. 1, the cylinder block apparatus 1 is structured such that a piston assembly 10 and a cylinder block 20 are improved in comparison with the conventional cylinder block apparatus.

Each of the piston assemblies is constituted by a piston rod 37 and a piston 11, and both elements are slidably connected to each other. Both ends of the piston rod 37 is constituted by spherical portions 37*a* and 37*b,* and these portions are connected by a rod 37*c*.

The piston 11 is constituted by a circular column having a circular hole pierced from a side of one end surface in an axial direction, and a bottom of the hole is formed in a semispherical shape. A spherical portion 37*a* disposed at one end of the piston rod 37 is inserted to a semispherical portion on the bottom of the hole in the piston 11, and both elements are connected by deforming an outer diameter of the piston 11. The piston 11 can be oscillated in a range at which the piston rod 37 is brought into contact with the hole 11*b*. Further, the spherical portion 37*b* at the other end portion of the piston rod 37 is mounted to a flange portion 31*a* of a drive shaft 31 in such a manner as to freely oscillate. An outer diameter of the side of the other end surface of the piston 11 is inserted to a cylinder block 20 mentioned below in a sealing manner so as to seal a high pressurized oil acting on the side of the other end surface of the piston 11 by an outer peripheral portion 12 of the piston 11 (hereinafter, refer to a seal land 12).

The piston 11 includes a structure in which a shape of a groove on the outer periphery and an arrangement or a size of an outer diameter are different in a longitudinal direction. The seal land 12 for sealing a high pressure acting on an end surface thereof together with the cylinder block 20 is provided in a right side R (a side of a suction and discharge port 21 in the cylinder block 20) shown in FIG. 1 on the outer periphery of the piston 11. On the contrary, an oil introduction groove 13 communicating with an inner portion of a case drain 39 is provided in a left side L of the piston 11 (a side of the other end surface of the cylinder block 20). Further, an outer peripheral groove 14 having an outer diameter deformed for connecting the piston 11 to the piston rod 37 is provided on the outer periphery of the piston 11. The outer peripheral groove 14 may be omitted by changing a processing method (a connecting method).

FIGS. 2A to 2E show five kinds of outer appearances of the piston assembly in accordance with the present invention. Piston assemblies 10A to 10E are respectively constituted by the piston rods 37 and pistons 11A to 11E, and both elements are connected to each other in such a manner as to freely oscillate.

Figure 2A:
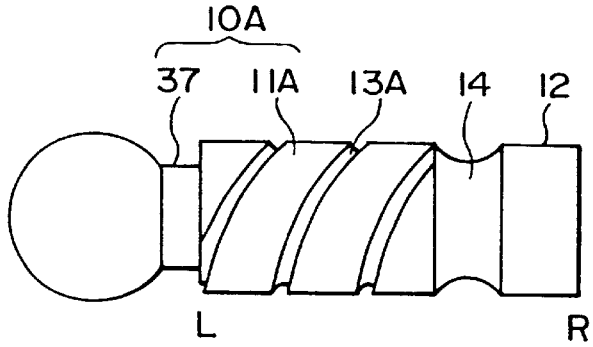
FIGS. 2A to 2E are views which show first to fifth embodiments of a piston assembly in accordance with a cylinder block apparatus shown in FIG. 1.

FIG. 2A shows a piston assembly 10A in accordance with a first embodiment, in which a piston 11A is structured such that an oil introduction groove 13A, an outer peripheral groove 14 and a seal land 12 are subsequently arranged from the side L of the case drain 39 to the right side R. In this case, the oil introduction groove 13A is formed by one spiral groove.

Figure 2B:
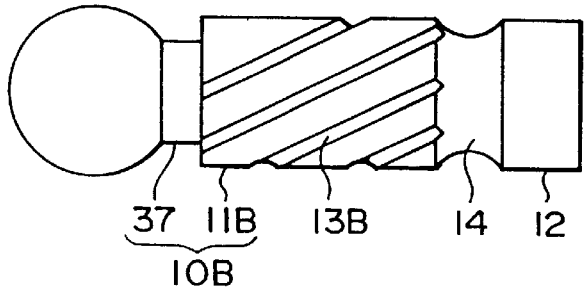

FIG. 2B shows a piston assembly 10B in accordance with a second embodiment, in which a piston 11B is structured such that a groove is arranged in the same manner as that of the piston 11A, however, an oil introduction groove 13B is an inclined groove comprising a plurality of straight lines.

Figure 2C:
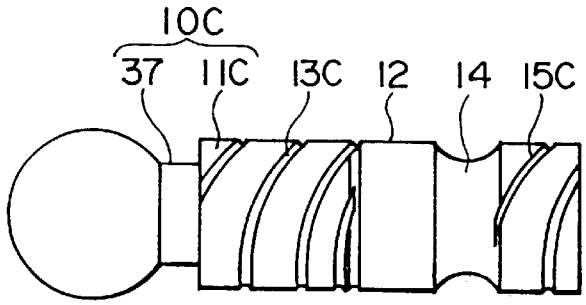

FIG. 2C shows a piston assembly 10C in accordance with a third embodiment, in which a piston 11C is structured such that an oil introduction groove 13C, the seal land 12, an outer peripheral groove 14 and an introduction groove 15 are subsequently arranged from the side L of the case drain 39 to the right side R. In this case, each of the oil introduction groove 13C and the introduction groove 15C is respectively formed by one spiral groove.

Figure 2D:
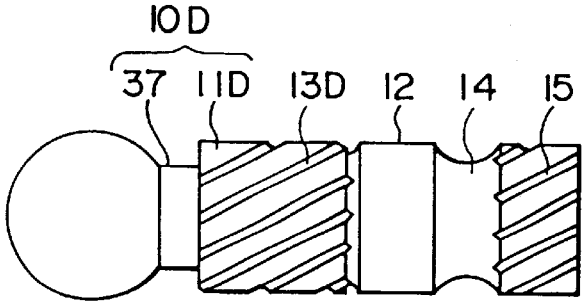

FIG. 2D shows a piston assembly 10D in accordance with a fourth embodiment, in which a piston 11D is structured such that a groove is arranged in the same manner as that of the piston 13C, however, each of an oil introduction groove 13D and an introduction groove 15D is an inclined groove comprising a plurality of straight lines.

Figure 2E:
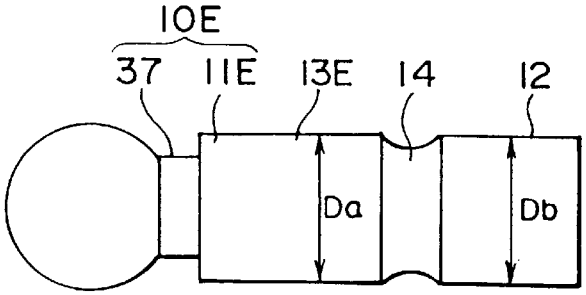

FIG. 2E shows a piston assembly 10E in accordance with a fifth embodiment, in which a piston 11E is structured such that an oil introduction portion 13E having a small diameter Da, an outer peripheral groove 14 and the seal land 12 having a thick diameter Db are subsequently arranged from the side L of the case drain 39 to the right side R. That is, the diameter Db of the seal land 12 is set to be greater than the diameter Da of the oil introduction portion 13E so as to seal a high pressure acting on the end surface in the right side R of the piston 11E together with the cylinder block 20.

Figure 3B:
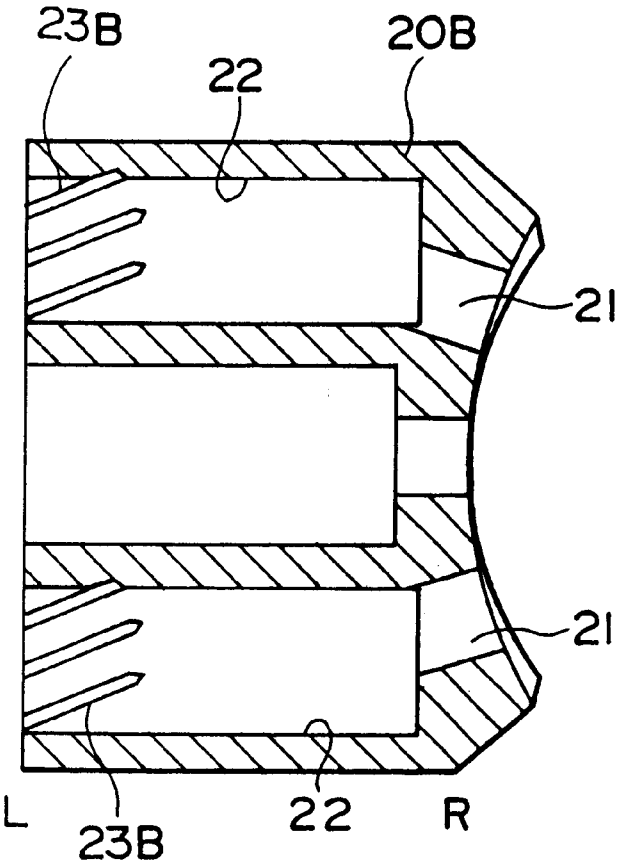
Figure 3A:
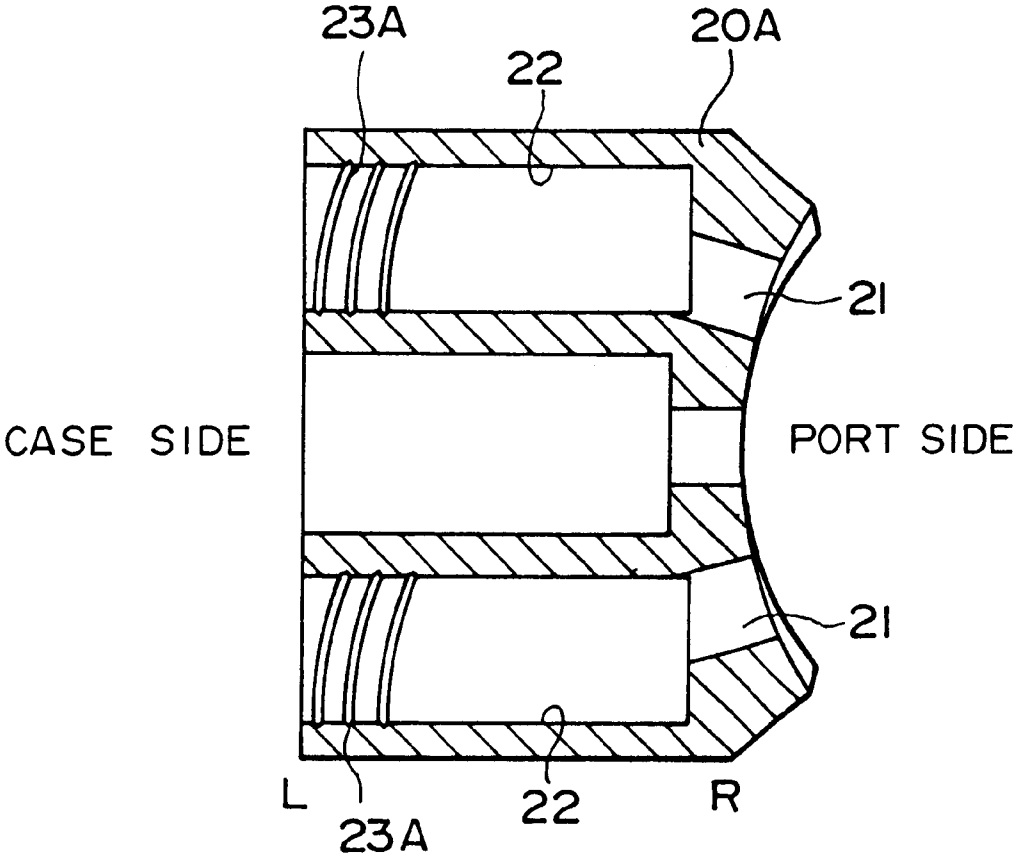

FIGS. 3A to 3B are cross sectional views of the cylinder block 20A and 20B in the cylinder block apparatus 1, and a plurality of suction and discharge ports 21 are provided in the right side R of the end surface. A plurality of cylinder holes 22 connected to the suction and discharge ports 21 and arranged on an inner circumference at a uniform interval are provided within the cylinder blocks 20A and 20B. Each of the pistons 11 is inserted to each of the cylinder holes 22 from the left side L of the cylinder blocks 20A and 20B (the side of the case) in a sealing manner, so that the high pressurized oil acting on the right end surfaces of the pistons 11 is sealed by the seal land 12 of the piston 11. The pressurized oil leaking from the gap between the cylinder 22 and the piston 11 is drained within the case 32 from the left side L (refer to FIG. 1).

An oil introduction groove 23A or 23B communicating with the inner portion of the case 32 is provided at a predetermined range from the left side L in an inner diameter portion of the cylinder hole 22. The predetermined range of the oil introduction groove 23A or 23B corresponds to a range at which the oil introduction groove 23A or 23B can seal without overlapping the seal land 12 when an inclination angle of the cylinder block 20 shown in FIG. 1 is large and an illustrated upper piston 11 comes out largely.

FIG. 3A shows a cylinder block 20A in accordance with a sixth embodiment, in which each of the oil introduction grooves 23A of a plurality of cylinder holes 22 is constituted by one spiral groove.

FIG. 3B shows a cylinder block 20B in accordance with a seventh embodiment, in which each of the oil introduction grooves 23B of a plurality of cylinder holes 22 is constituted by an inclined groove comprising a plurality of straight lines.

Next, a description will be given of an operation of a piston motor provided with the cylinder block apparatus 1 mentioned above.

In FIG. 1, in a state that the cylinder block apparatus 1 is adjusted to a predetermined inclination angle, the high pressurized oil flows into the cylinder hole 22 from a high pressure port (not shown) of the valve plate 43 via the suction and discharge port 21 in the cylinder block 20. As a result, the piston assembly 10 is pushed out from the cylinder block 20, and the drive shaft 31 rotates together with the cylinder block apparatus 1 in response to a component force in a rotational direction from the spherical portion 37*a* at one end of the piston rod 37. On the contrary, the piston assembly 10 is pressed within the cylinder block 20 due to the rotational force of the drive shaft 31, and the oil flows out to a low pressure port (not shown) of the valve plate 43 via the suction and discharge port 21. The drive shaft 31 rotates with repeating the state mentioned above.

Figure 4:
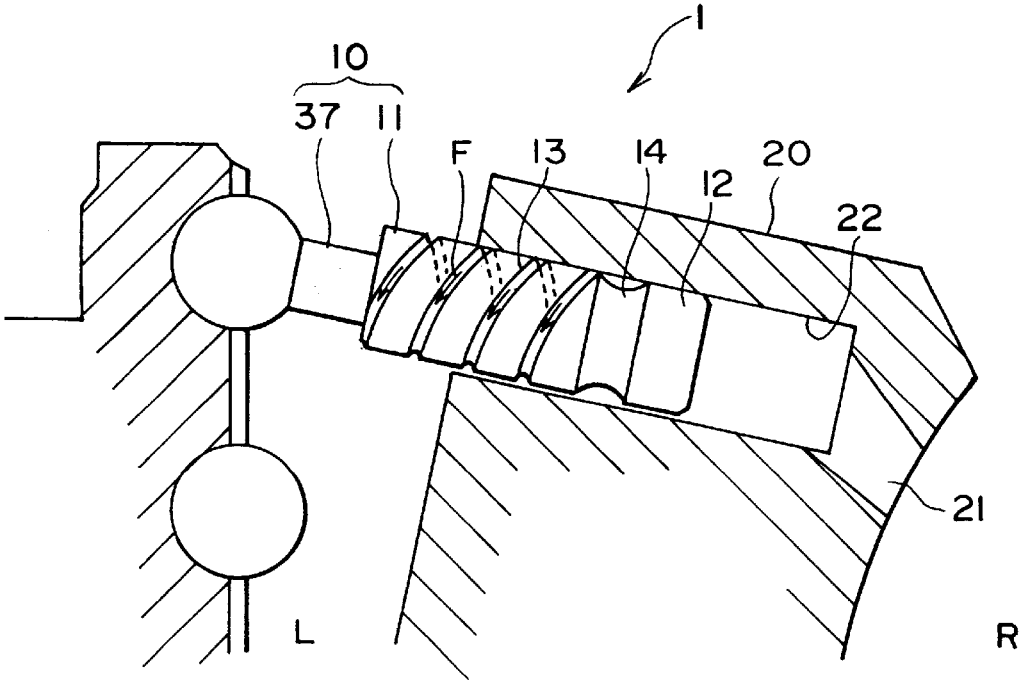
FIG. 4 is a view which explains an operation of a piston and a cylinder block in accordance with the cylinder block apparatus shown in FIG. 1.

Here, details of an operation of the cylinder block apparatus 1 will be described below on the basis of an embodiment shown in FIG. 4.

In addition to the seal land 12 and the outer peripheral groove 14 which are the same as those in the conventional structure, an oil introduction groove 13 inclined with respect to an oscillating direction of the piston assembly 10 and communicating with the case drain 39 from the outer peripheral groove 14 is provided on the outer periphery of the piston 11 in the piston assembly 10. Accordingly, the oil leaking from the seal land 12 flows on the inclined oil introduction groove 13 from the R side (a high pressure side of the piston 11) to the left side L (a side of the case drain 39) along an arrow F so as to lubricate and cool all the periphery of the piston 11. Accordingly, even when the piston 11 is shifted within the cylinder hole 22 due to a centrifugal force caused by the high speed rotation, a heat generation and a seizure due to the sliding friction are not generated, so that a cooling effect can be obtained. Further, since it is possible to lubricate and cool all the periphery, a gap between the seal land 12 and the cylinder hole 22 can be made equal to or smaller than the conventional one, a capacity efficiency at a time of rotating at a low speed can be made equal or improved. Still further, since all the passage of the oil introduction groove 13 is always communicated with the oil within the case drain 39, the oil within the case drain 39 is supplied to the oil introduction groove 13 and the outer peripheral groove 14 even when the piston assembly 10 is pushed within the cylinder hole 22 by the rotational force of the drive shaft 31, so that a heat generation and a seizure due to a sliding friction are not generated, and a cooling effect can be obtained.

Figure 5:
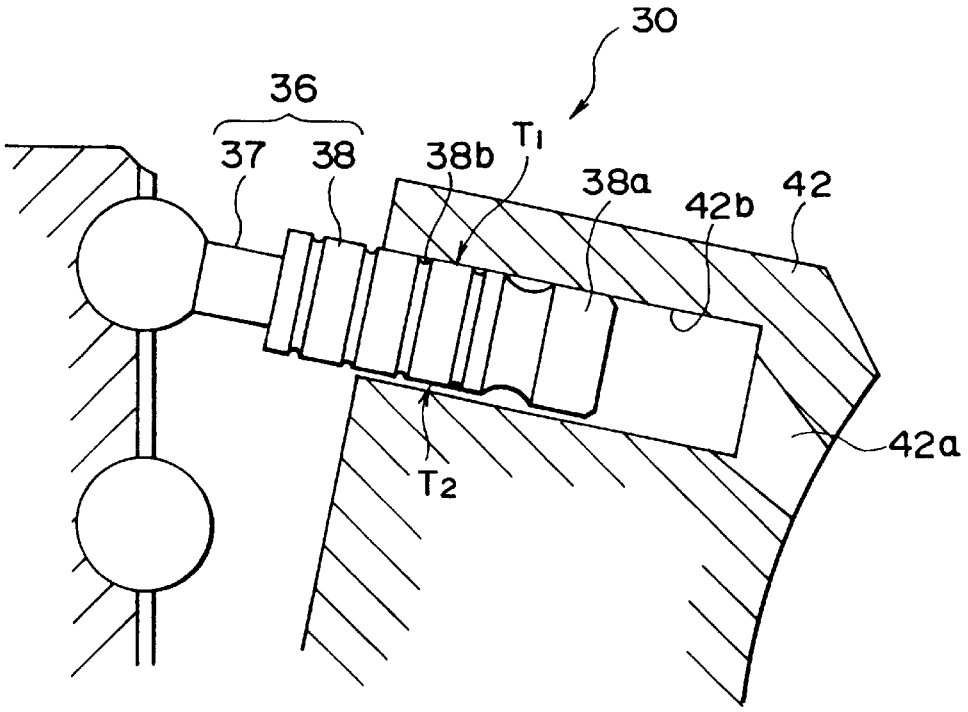
FIG. 5 PRIOR ART
FIG. 5 is a view which explains an operation of a piston and a cylinder block in accordance with a conventional cylinder block apparatus.
Figure 6:
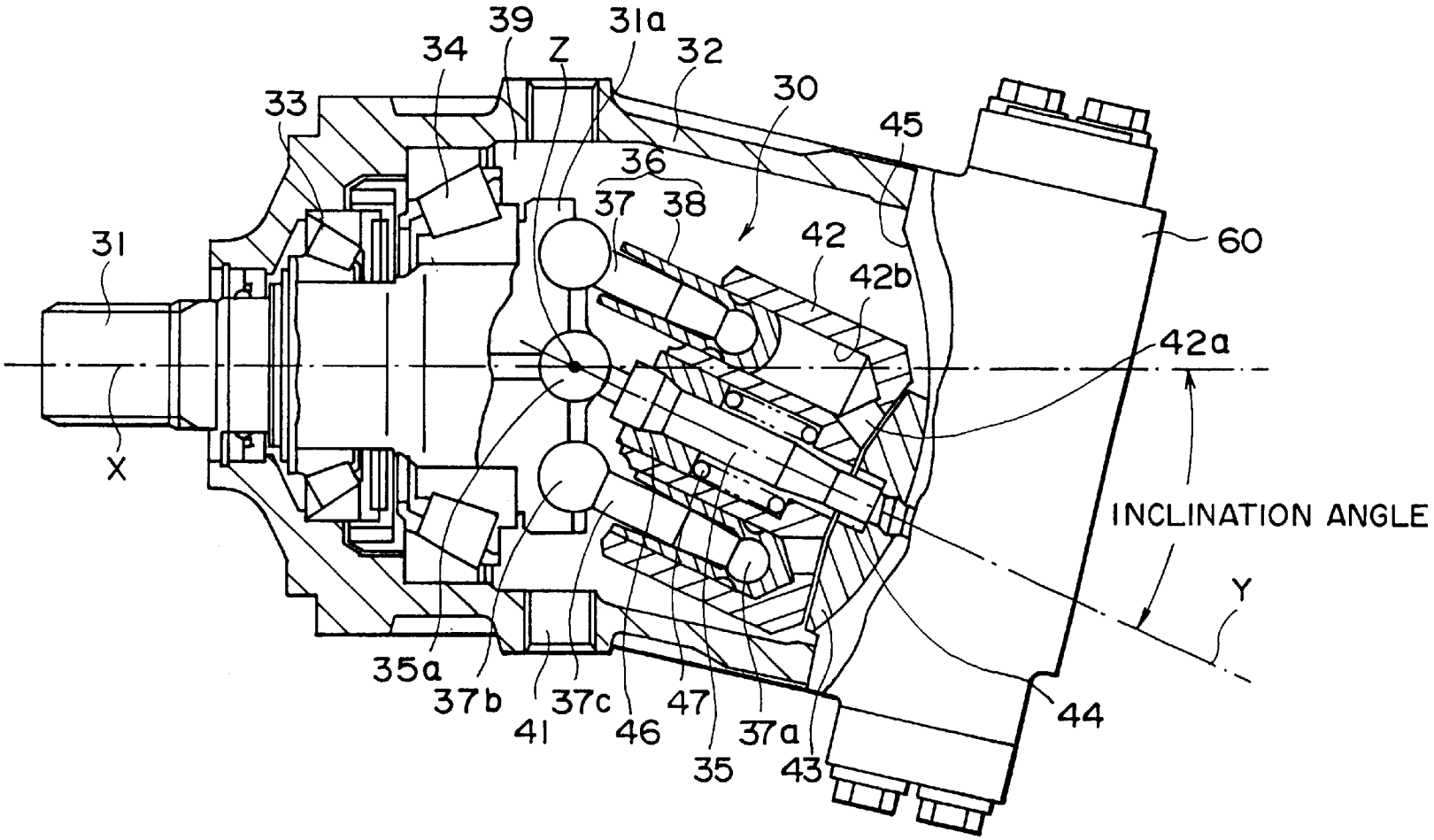
FIG. 6 PRIOR ART
FIG. 6 is a cross sectional view of a conventional piston motor.
Figure 9:
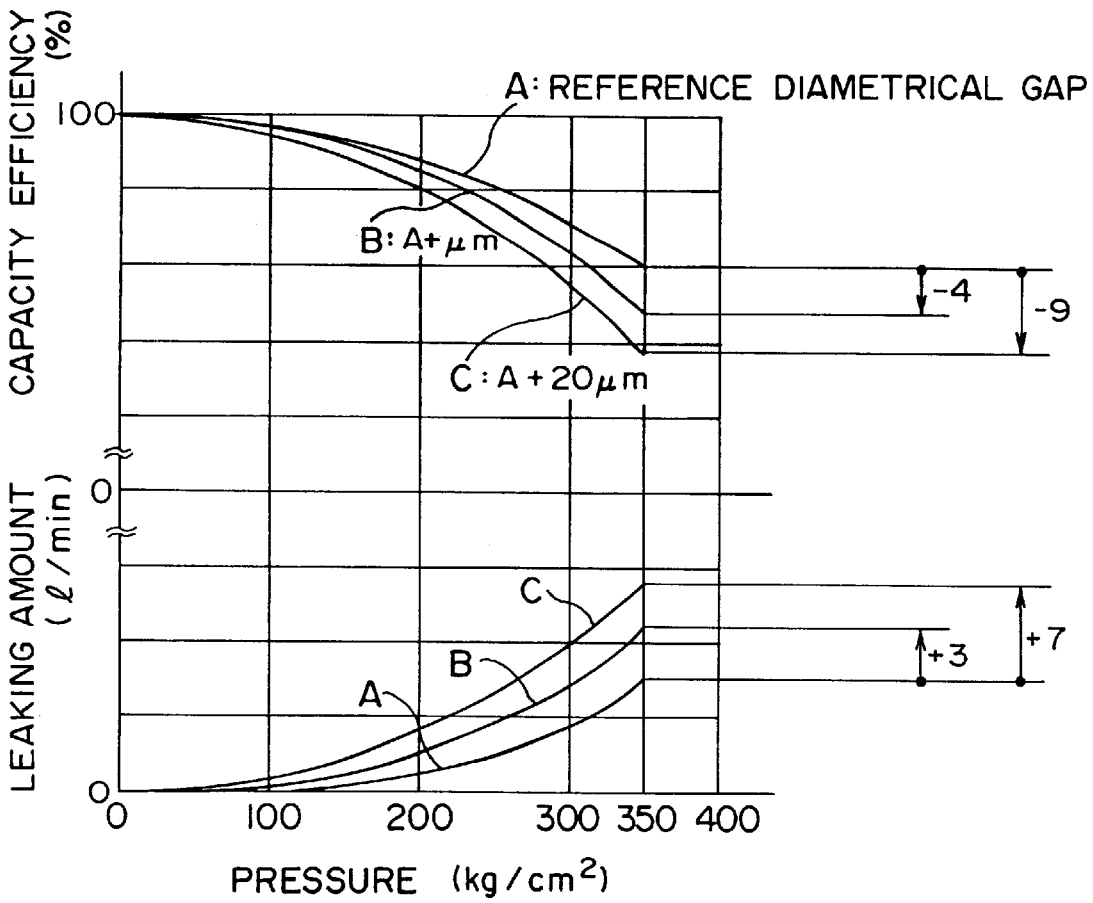
FIG. 9 is a graph which shows an experimental value of diametrical gap, a leaking amount and a capacity efficiency.

On the contrary, FIG. 5 is a view which explains an operation of the conventional cylinder block apparatus 30. When the inclination angle is reduced, an upper piston assembly 36 shown in FIG. 6 is further inserted within the cylinder hole 42*b*, an insertion depth of a lower piston assembly 36 becomes small, and a stroke S becomes small. Accordingly, a labyrinth groove 38*b* in a center portion of the piston 38 does not protrude within the case drain 39 from the cylinder block 42. When the piston 38 is shifted within the cylinder hole 42*b* due to a centrifugal force caused by a speed rotation and the like, the oil leaking from a larger gap T2 via the seal land 38*a* flows much, so that a side of the gap T2 is cooled. On the contrary, the oil leaking via the seal land portion 38*a* hardly flows from a side of a smaller gap T1, so that a temperature of the flowing oil is increased. As a result, a viscosity of the oil is reduced, and the side of the gap T1 becomes further smaller. The side of the gap T1 locally generates heat due to a sliding friction so as to become a high temperature by repeating the operation mentioned above, so that a seizure is generated in the piston 38.

Next, by using the piston 38 in accordance with the conventional art in which a plurality of labyrinth grooves 38*b* shown in FIG. 7B are cut, the piston 11A in which one spiral groove shown in FIG. 2A in accordance with the present invention is formed and the piston 11E having no spiral groove shown in FIG. 2E, a comparative test of a seizure at a high speed rotation and a capacity efficiency at a low speed rotation is performed. The results are as shown in Table 2.

(1) In the conventional products, a seizure is generated at a high speed rotation (a rotational speed 5000 rpm and a pressure 210 kg/cm$^2$) even when the diametrical gap is a value corresponding to a reference +10 $\mu$m and a value corresponding to a reference +20 $\mu$m. In the reference 10 $\mu$m, the outer diameter portion of the piston 38 and the cylinder hole 42*b* are locked.

(2) In the products of the present invention, a seizure is not generated in any one thereof at a high speed rotation. Further, with respect to a capacity efficiency at a low speed rotation (a rotational speed 500 rpm and a pressure 350 kg/cm$^2$), a standard is satisfied in all of the products (at about 87% or more).

(3) In the products of the present invention, a rotational speed about 20% higher than the conventional rotational speed can be obtained.

(4) An oil leakage from the pistons 11A (FIG. 2A) and 11E (FIG. 2E) of the products in accordance with the present invention is about 0.4 l/min, which is a little smaller than the conventional one.

TABLE 2

WHETHER OR NOT SEIZURE AT HIGH SPEED ROTATION IS GENERATED AND COMPARISON OF CAPACITY EFFICIENCY AT LOW SPEED ROTATION

| LEVEL | | | | TEST RESULT | | |
|---|---|---|---|---|---|---|
| | | | | | CAPACITY | |
| OLD OR NEW | NO | DIAMETRICAL GAP ($\mu$m) | SHAPE OF OIL INTRODUCTION GROOVE | SEIZURE AT HIGH SPEED ROTATION | EFFICIENCY AT LOW SPEED ROTATION % | TOTAL JUDGMENT |
| PRIOR ART | 1 | REFERENCE + 10 | LABYRINTH GROOVE | YES | REFERENCE | X |

TABLE 2-continued

| WHETHER OR NOT SEIZURE AT HIGH SPEED ROTATION IS GENERATED AND COMPARISON OF CAPACITY EFFICIENCY AT LOW SPEED ROTATION | | | | | | |
|---|---|---|---|---|---|---|
| | LEVEL | | | TEST RESULT | | |
| OLD OR NEW | NO | DIAMETRICAL GAP (μm) | SHAPE OF OIL INTRODUCTION GROOVE | SEIZURE AT HIGH SPEED ROTATION | CAPACITY EFFICIENCY AT LOW SPEED ROTATION % | TOTAL JUDGMENT |
| | 2 | REFERENCE + 20 | LABYRINTH GROOVE | YES | REFERENCE − 5 | X |
| | 3 | REFERENCE + 30 | LABYRINTH GROOVE | NO | REFERENCE − 7 | X |
| PRESENT INVEN-TION | 4 | REFERENCE | SPIRAL GROOVE (FIG. 2A) | NO | REFERENCE | ○ |
| | 5 | REFERENCE + 10 | SPIRAL GROOVE (FIG. 2A) | NO | REFERENCE − 1 | ○ |
| | 6 | BELOW (1) | SPIRAL GROOVE (FIG. 2A) | NO | REFERENCE | ○ |
| | 7 | BELOW (2) | NO GROOVE (FIG. 2E) | NO | REFERENCE | ○ |

(1) A piston at a test level 6 is structured such as to set the seal land 12 to a diametrical gap corresponding to a reference and the spiral groove portion to a diametrical gap corresponding to a reference −30 μm.

(2) A piston at a test level 7 is structured such as to set the thick diameter (Db) portion to a diametrical gap corresponding to a reference and the thin diameter (Da) portion to a diametrical gap corresponding to a reference −30 μm.

| Operation condition at a high speed rotation | Operation condition at a low speed rotation |
|---|---|
| Rotational speed: 5000 rpm<br>Pressure: 210 kg/cm$^2$ | Rotational speed: 500 rpm<br>Pressure: 350 kg/cm$^2$ |

Further, it is not described in Table 2, however, the same effect can be obtained in a test result performed by providing the oil introduction groove 23A comprising one spiral corresponding to the test level 4 only in the cylinder hole 22 (FIG. 3A) of the cylinder block 20A.

Still further, with respect to the oil introduction groove 13B comprising a plurality of inclined straight lines (FIG. 2B), the same effect can be obtained, and since the oil in the case 32 is introduced by the oil introduction grooves 13B, a seizure resistance is further improved.

Furthermore, in FIGS. 2C and 2D, since the high pressurized oil is positively introduced to a portion near the center of the piston 11 by providing the introduction grooves 15C and 15D connecting to the high pressure side of the piston 11C, a lubricating and cooling effect is increased, and a seizure resistance is further improved. In this case, even when making the inner diameter of the cylinder hole 22 in the side of the case drain 39 larger than the inner diameter of the cylinder block 20 in the side of the suction and discharge port 21, a lubricating and cooling effect is increased and the same effect can be obtained.

When making the outer diameter of the piston 11 in the side of the case drain 39 than the seal land 12 in the side of the suction and discharge port 21 at the same time of providing the spiral oil introduction groove 13 inclining with respect to an oscillating direction of the outer peripheral groove 14 and the piston assembly 10 and communicating with the case drain 39 from the outer peripheral groove 14 in the piston 11 (FIG. 4), a lubricating and cooling effect of the piston assembly 10 can be further increased. In this case, the same effect can be obtained by making the inner diameter in the side of the case drain 39 larger than that in the side of the suction and discharge port 21 as well as providing the oil introduction groove 13 only in the cylinder hole 22 of the cylinder block 20.

INDUSTRIAL APPLICABILITY

The present invention is useful for the cylinder block apparatus which can prevent a heat generation and a seizure due to a sliding friction between the piston and the cylinder in the inclined shaft type and the swash plate type hydraulic pumps even when the piston pump and motor are made high speed.

What is claimed is:

1. A piston pump motor comprises a cylinder block rotatably supported within a case, said cylinder block having suction and discharge ports in a first end surface thereof, said cylinder block being provided with a plurality of cylinder holes arranged on an inside circumference at a uniform interval with each cylinder hole being connected to a respective suction and discharge port, and a plurality of pistons, each piston sliding within a respective cylinder hole in a sealing manner and having a part moving forward and backward from a second end surface of the cylinder block, wherein an oil introduction groove, communicating with a side of a case drain, is provided in a portion disposed on an inner periphery of a respective cylinder hole and at which a part of the respective piston moves forward and backward from the second end surface, and a seal land, for sealing a high pressurized oil in a side of a respective suction and discharge port, is provided on an outer periphery of each respective piston, wherein each respective cylinder hole has a large inner diameter portion provided in a vicinity of the second end surface of said cylinder block, said large inner diameter portion having an inner diameter that is larger than an inner diameter of a portion of said cylinder hole which is in a vicinity of the first end surface of said cylinder block.

2. A piston pump motor as claimed in claim 1, wherein an outer peripheral groove having a diameter smaller than the seal land is provided on the outer periphery of said piston and between said oil introduction groove and said seal land.

3. A piston pump motor as claimed in claim 1, wherein the oil introduction groove communicating with the side of said case drain, said seal land, an outer peripheral groove having a diameter smaller than the seal land, and an introduction groove communicating with the side of said suction and discharge port are subsequently provided on the outer periphery of said piston.

4. A piston pump motor comprises a cylinder block rotatably supported within a case, said cylinder block having suction and discharge ports in a first end surface thereof, said cylinder block being provided with a plurality of cylinder holes arranged on an inside circumference at a uniform interval with each cylinder hole being connected to a respective suction and discharge port, and a plurality of pistons, each piston sliding within a respective cylinder hole in a sealing manner and having a part moving forward and backward from a second end surface of the cylinder block, wherein an oil introduction groove, communicating with a side of a case drain, is provided in a portion disposed on an outer periphery of a respective piston and moving forward and backward from the second surface of said cylinder block, and a seal land, for sealing a high pressurized oil in a side of a respective suction and discharge port, is provided on an outer periphery of each respective piston, wherein each respective piston has a small outer diameter portion provided in a vicinity of the second end surface of said cylinder block, said small outer diameter portion having an outer diameter that is smaller than an outer diameter of a portion of said piston which is in a vicinity of the first end surface of said cylinder block.

5. A piston pump motor as claimed in claim 4, wherein an outer peripheral groove having a diameter smaller than the seal land is provided on the outer periphery of said piston and between said oil introduction groove and said seal land.

6. A piston pump motor as claimed in claim 4, wherein the oil introduction groove communicating with the side of said case drain, said seal land, an outer peripheral groove having a diameter smaller than the seal land and an introduction groove communicating with the side of said suction and discharge port are subsequently provided on the outer periphery of said piston.

* * * * *